US006883558B2

(12) United States Patent
Jander

(10) Patent No.: US 6,883,558 B2
(45) Date of Patent: Apr. 26, 2005

(54) METHOD OF FILLING A MUFFLER CAVITY WITH FIBROUS MATERIAL

(75) Inventor: Michael H. Jander, Eupen (BE)

(73) Assignee: Owens Corning Composites, S.P.R.L., Brussels (BE)

( * ) Notice: Subject to any disclaimer, the term of this patent is extended or adjusted under 35 U.S.C. 154(b) by 86 days.

(21) Appl. No.: 10/675,182

(22) Filed: Sep. 30, 2003

(65) Prior Publication Data

US 2005/0067044 A1 Mar. 31, 2005

(51) Int. Cl.[7] ..... B65B 1/04

(52) U.S. Cl. ..... 141/1; 141/67; 141/70; 29/890.08

(58) Field of Search ..... 141/1, 67, 11, 141/12, 70, 71; 181/222, 252, 256, 257, 258; 29/890.08

(56) References Cited

U.S. PATENT DOCUMENTS 5,036,585 A 8/1991 Schweinfurth
5,976,453 A * 11/1999 Nilsson et al. ..... 264/555
6,068,082 A 5/2000 D'Amico, Jr. et al.
6,148,519 A 11/2000 Stenersen et al.
6,317,959 B1 * 11/2001 Nilsson et al. ..... 29/455.1
6,446,750 B1 * 9/2002 Lewin ..... 181/256
6,457,555 B1 10/2002 Saughnessy
6,581,723 B2 * 6/2003 Brandt et al. ..... 181/256
2001/0011780 A1 8/2001 Knutsson
2003/0042070 A1 3/2003 Brandt et al.
2003/0047381 A1 3/2003 Brandt et al.

* cited by examiner

*Primary Examiner*—Steven O. Douglas
(74) *Attorney, Agent, or Firm*—Inger H. Eckert; Maria C. Gasaway

(57) ABSTRACT

A method for filling a muffler shell with a fibrous material includes providing an outer muffler shell, applying a temporary form to the outer shell to define a muffler chamber within the outer muffler shell, and wetting the fibrous material by forcing moisturized compressed air into contact with the fibrous material. The wetted fibrous material is inserted into the muffler chamber, and the temporary form is removed from the outer muffler shell.

29 Claims, 8 Drawing Sheets

METHOD OF FILLING A MUFFLER CAVITY WITH FIBROUS MATERIAL

TECHNICAL FIELD

This invention relates to a method of filling a muffler shell with fibrous material. More particularly, the invention pertains to a method of filling a muffler shell that prevents the fibrous material from expanding beyond the cavity in the muffler to be filled.

BACKGROUND OF THE INVENTION

Exhaust mufflers often include a sound absorbing material within the interior of the muffler to dampen the sound made by the escaping gases that pass through the muffler. Many types of exhaust mufflers are produced by mechanically joining multiple pieces to form a muffler shell. For example, a common type of exhaust muffler is a clamshell muffler, which is assembled by joining an upper section to a lower section by welding or crimping. Another common construction for mufflers uses a single body portion that is sealed by joining end portions to the body portion by welding or crimping. A common material used to fill exhaust mufflers is glass fibers. The fibers usually fill at least part of the interior muffler cavity, and are often inserted into the muffler in a volumized form that makes them somewhat difficult to contain. Often, when volumized fibers are used, fibers stray from the interior muffler cavity and become trapped between the sections of the muffler shell. The trapped fibers subsequently have an adverse effect on the quality of the joint between the sections of the muffler. Hence, there is a need for an improved muffler filling process.

SUMMARY OF THE INVENTION

The above objects as well as other objects not specifically enumerated are achieved by a method for filling a muffler shell with a fibrous material. The method includes providing an outer muffler shell, applying a temporary form to the outer shell to define a muffler chamber within the outer muffler shell, and wetting the fibrous material by forcing moisturized compressed air into contact with the fibrous material. The wetted fibrous material is inserted into the muffler chamber, and the temporary form is removed from the outer muffler shell.

According to this invention there is also provided a method for filling a muffler shell with a fibrous material. The method includes providing an outer muffler shell having at least one muffler chamber defined within the outer muffler shell, wetting the fibrous material by forcing moisturized compressed air into contact with the fibrous material, and inserting the wetted fibrous material into the muffler chamber.

According to this invention there is also provided a method for filling a muffler shell with a fibrous material. The method includes providing a muffler shell having a lower outer shell, applying a temporary form to the lower outer shell to define a muffler chamber within the lower outer shell, texturizing the fibrous material by forcing compressed air through the fibrous material, and wetting the texturized fibrous material by applying water to the texturized fibrous material. The texturized and wetted fibrous material is inserted into the enclosed muffler chamber, and the temporary form is removed from the lower outer shell.

According to this invention there is also provided a method for filling a muffler shell with a fibrous material, where the method includes providing a muffler shell having a lower outer shell, and applying a temporary form to the lower outer shell to define a muffler chamber within the lower outer shell. The fibrous material is simultaneously texturized and wetted by forcing moisturized compressed air into contact with the fibrous material. The wetted fibrous material is inserted into the muffler chamber, and the temporary form is removed from the lower outer shell.

Various objects and advantages of this invention will become apparent to those skilled in the art from the following detailed description of the preferred embodiments, when read in light of the accompanying drawings.

DETAILED DESCRIPTION OF THE INVENTION

Figure 1:
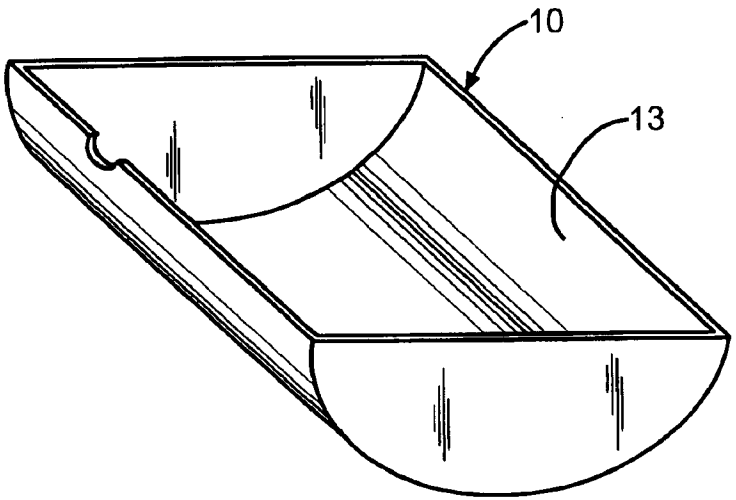
FIG. 1 is a schematic view in perspective of the lower outer shell of a muffler.
Figure 13:
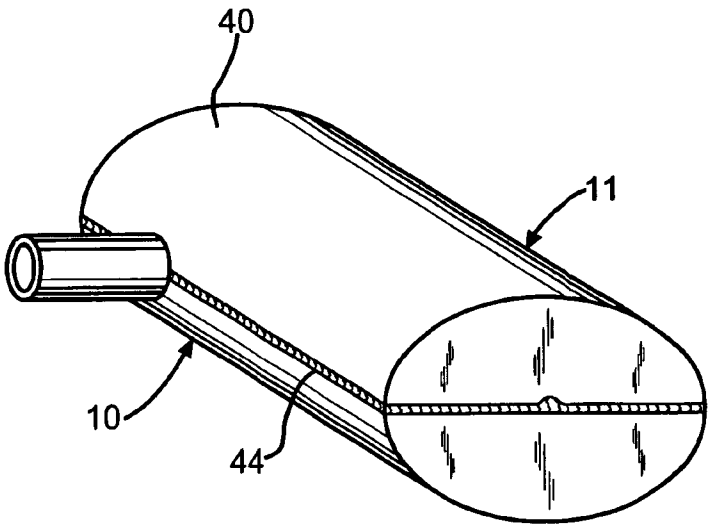
FIG. 13 is a schematic view in perspective of a completed muffler assembly.

Exhaust muffler shells are generally formed in multiple pieces, which are subsequently joined together by any suitable mechanical fastening operation, such as welding or crimping. FIGS. 1 and 13 illustrate a common configuration for a muffler shell design often referred to as a clamshell muffler. A clamshell muffler 11 is generally comprised of a lower outer shell 10 and an upper outer shell 40. Generally, the lower outer shell 10 and upper outer shell 40 are formed from a metal or metal alloy material, although it will be appreciated that any suitable material may be used for the lower outer shell 10 and upper outer shell 40. The lower outer shell 10 and upper outer shell 40 can be formed using any suitable forming process, such as hydroforming or stamping, and can be formed having any suitable shape and dimensions. In a preferred embodiment, the lower outer shell 10 and the upper outer shell 40 are generally formed such that the completed muffler assembly has an elongated elliptical shape, with each portion of the shell shaped as one half of the ellipse divided symmetrically about the horizontal axis of the completed muffler assembly. As shown in FIG. 1, the lower outer shell 10 has an internal cavity 13.

Figure 2:
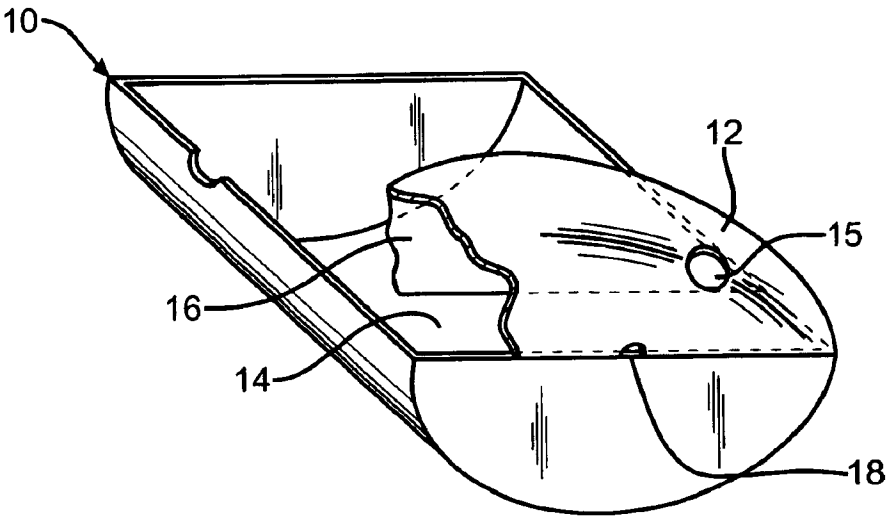
FIG. 2 is a schematic view in perspective of the temporary form fitted onto the lower outer shell.
Figure 3:
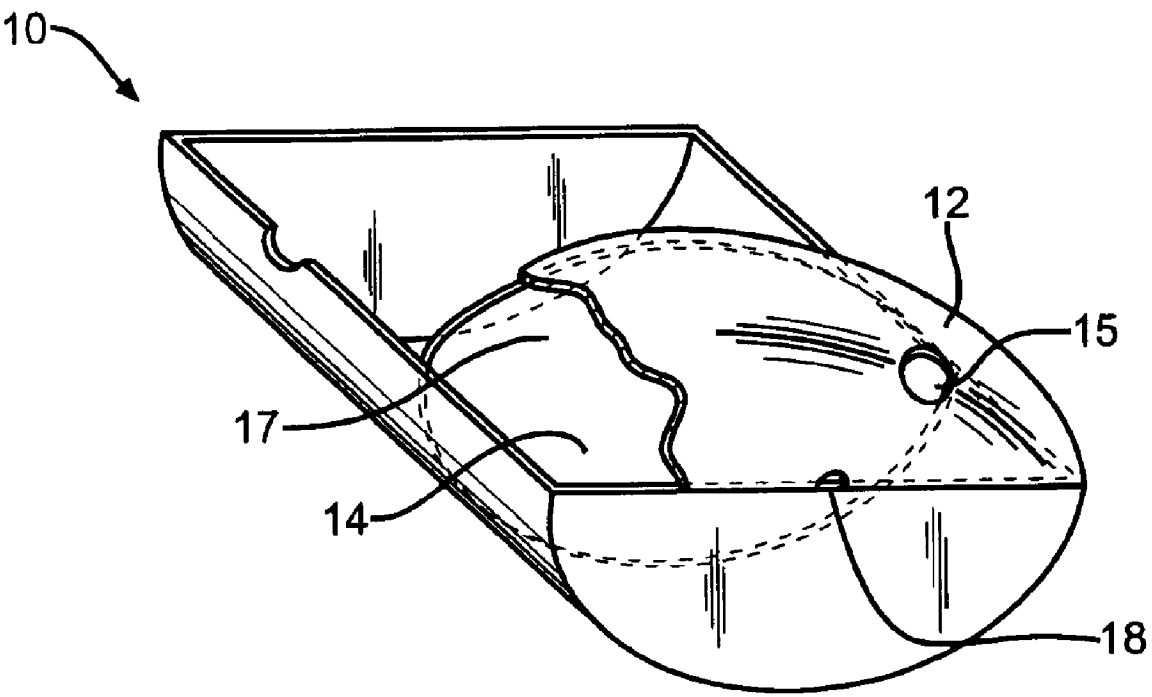
FIG. 3 is a schematic view in perspective of the temporary form fitted onto a lower outer shell having a permanent partition mounted therein.
Figure 4:
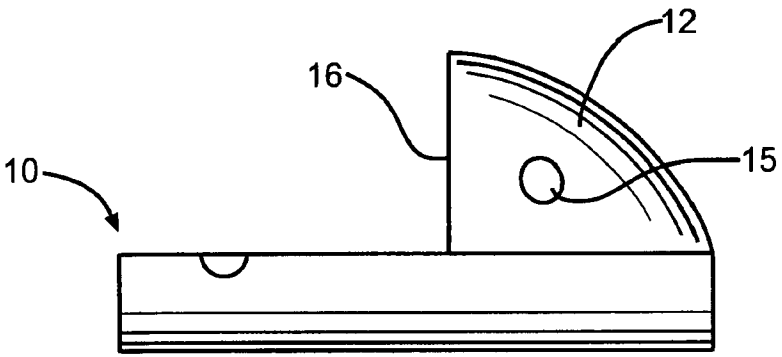
FIG. 4 is a side elevational view of the temporary form fitted onto the lower outer shell.

As shown in FIGS. 2 through 4, prior to filling the muffler with fibrous material, a temporary form 12 may be placed over the lower outer shell 10 to define a muffler chamber 14. The temporary form 12 preferably has a concave shape similar to the shape of the upper outer shell 40, although it will be appreciated that the temporary form 12 may have any suitable shape. The temporary form 12 may also include a back plate 16 that can be positioned within the internal cavity 13 of the lower outer shell 10 to define the muffler chamber 14. The temporary form 12 may be formed from any suitable rigid material, such as metal or plastic. Alternatively, the upper outer shell 40 may be used in place of the temporary form 12 to define the muffler chamber 14.

As shown in FIG. 3, the lower outer shell 10 may also contain an internal structure 17, consisting of any number and combination of pipes, partition plates, or baffles. The internal structure 17 is adapted to extend at least part way through the internal cavity 13 of the lower outer shell 10 to define the muffler chamber 14 within the internal cavity 13. Where the internal structure 17 defines the muffler chamber 14, the shape of the temporary form 12 may be adapted such that the temporary form 12 works in conjunction with the internal structure 17 to define the muffler chamber 14. Once again, the upper outer shell 40 may be used in place of the temporary form 12 to define the muffler chamber 14.

Referring to FIGS. 2 and 3, a plurality of sealable outlets 15 may also be included on the temporary form 12. The sealable outlets 15 may be used for additional operations in the filling process, such as the drawing of a vacuum within the muffler chamber 14 using vacuum lines, not shown, connected to the temporary form 12 through the outlets 15. The outlets 15 may be any size and shape suitable for connecting the vacuum lines to the temporary form 12, and consist generally of one or more holes in the temporary form 12. The outlets 15 in the temporary form 12 may be covered or capped to seal the outlets 15 when they are not being used. The temporary form 12 may also include a fill opening 18 to accommodate the filling apparatus used to insert the fibrous material into the muffler chamber 14. The fill opening 18 may be placed in any suitable location on the temporary form 12. In a preferred embodiment, the fill opening 18 is placed along the joint between the lower outer shell 10 and the temporary form 12.

Figure 5:
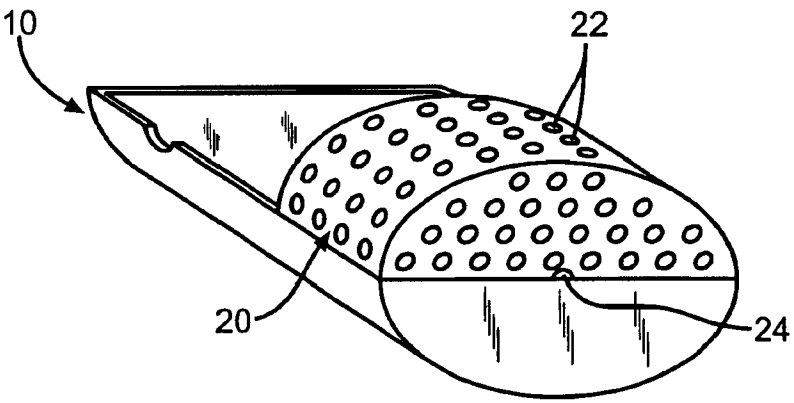
FIG. 5 is schematic view in perspective of a perforated temporary form fitted onto the lower outer shell.

FIG. 5 shows an alternative embodiment of the invention using a perforated form 20. The perforated form 20 is similar in size and shape to the temporary form 12, but is formed from a material having perforations 22. The perforations 22 may be of any suitable size and shape to allow air entering the muffler chamber 14 during the filling process to escape the muffler chamber 14, subsequently allows the fibrous material to fully fill the muffler chamber 14. The perforated form 20 may also include an opening 24 placed along the joint between the lower outer shell 10 and the perforated form 20 to accommodate the filling apparatus. It will be appreciated however, that the opening 24 may also be omitted, as any of the perforations 22 on the perforated form 20 may be used to accommodate the introduction of the fibrous material.

Figure 6:
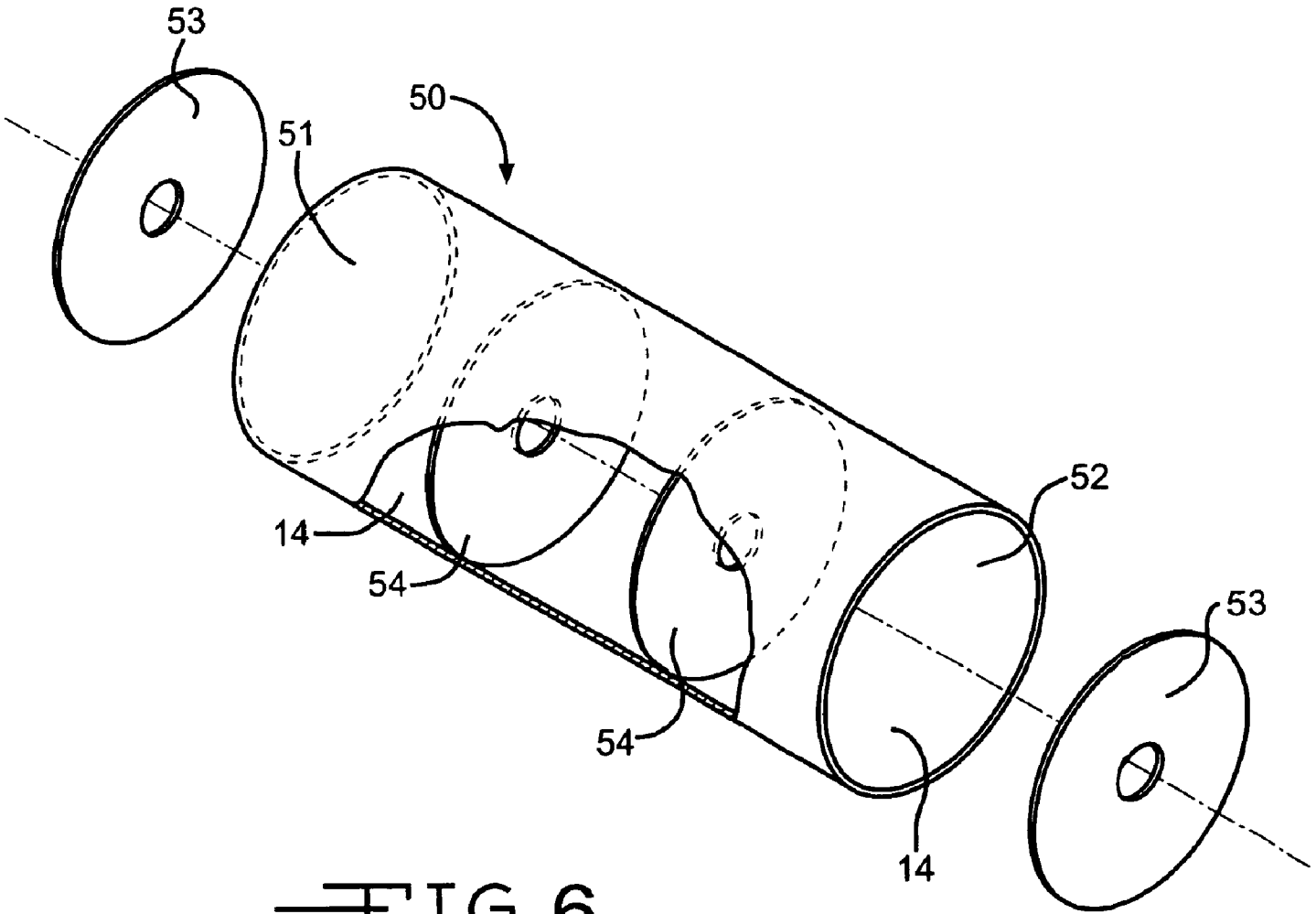
FIG. 6 is a schematic view in perspective of a cylindrical muffler shell having a plurality of permanent partitions mounted therein.

FIG. 6 illustrates an alternate muffler construction that may be filled according to the method of the present invention. In this embodiment, the outer shell 50 is comprised of a single body portion, as opposed to a clamshell muffler having an upper outer shell and a lower outer shell section. The outer shell 50 may be formed from a metal or metal alloy material, although it will be appreciated that any suitable material may be used to form the outer shell 50. The outer shell 50 can be formed using any suitable forming process, and can be formed having any suitable shape and dimensions. In a preferred embodiment, the outer shell 50 is generally formed having an elongated cylindrical shape that is open on each end 51, 52. The outer shell 50 may also contain at least one internal partition 54 to define individual muffler chambers 14 within the outer shell 50, although it will be appreciated that the internal partition 54 is not required. Where the single outer shell construction is used, the temporary form 12 may be omitted from the filling process, as the muffler chamber 14 defined by the outer shell 50 and the internal partition 54 is sufficiently enclosed to be filled according to the method of the present invention. To complete this type of muffler assembly, an end cap 53 is fastened to the each open end 51, 52 of the outer shell 50 using any suitable mechanical fastening means, such as welding, crimping, or fastening mechanisms.

After the lower outer shell 10 is fitted with the temporary form 12 or upper outer shell 40, the muffler chamber 14 is ready to be filled with fibrous material. A filling apparatus 26 is inserted into the fill opening 18 of the temporary form 12 to fill the muffler chamber 14. The filling apparatus 26 will be explained in greater detail below. At this point, a vacuum apparatus, not shown, may also be connected to the sealable inlets 15 on the temporary form 12. The vacuum apparatus may be used to draw a partial vacuum in the enclosed muffler chamber 14 during the filling process to draw the fibrous material 29 into the enclosed muffler chamber 14. Where a single outer shell 50 design is used, as shown in FIG. 6, the filling apparatus 26 may be inserted directly into an open end 51, 52 of te outer shell 50.

Figure 8:
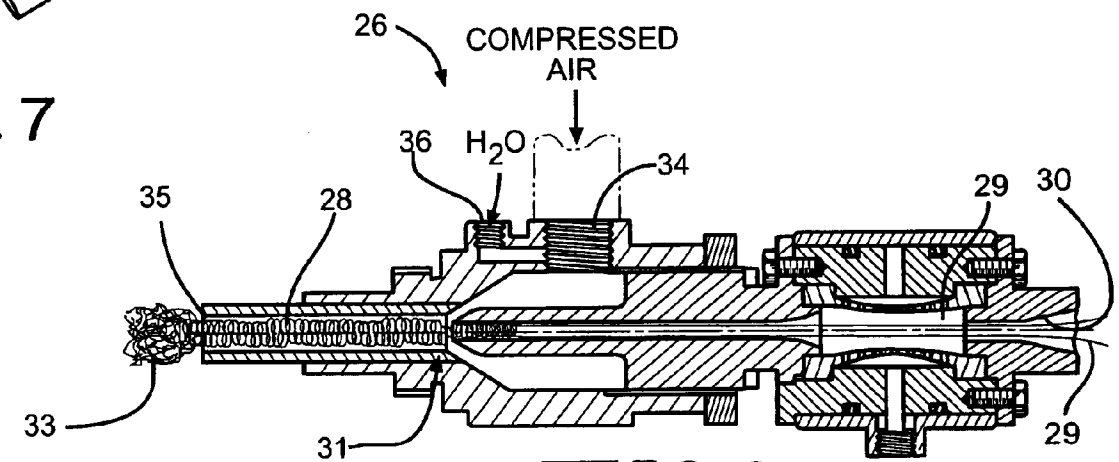
FIG. 8 is a cross-sectional view in elevation of a first embodiment of the filling apparatus that simultaneously texturizes and wets the fibrous material prior to inserting the fibrous material into the enclosed muffler chamber.
Figure 9:
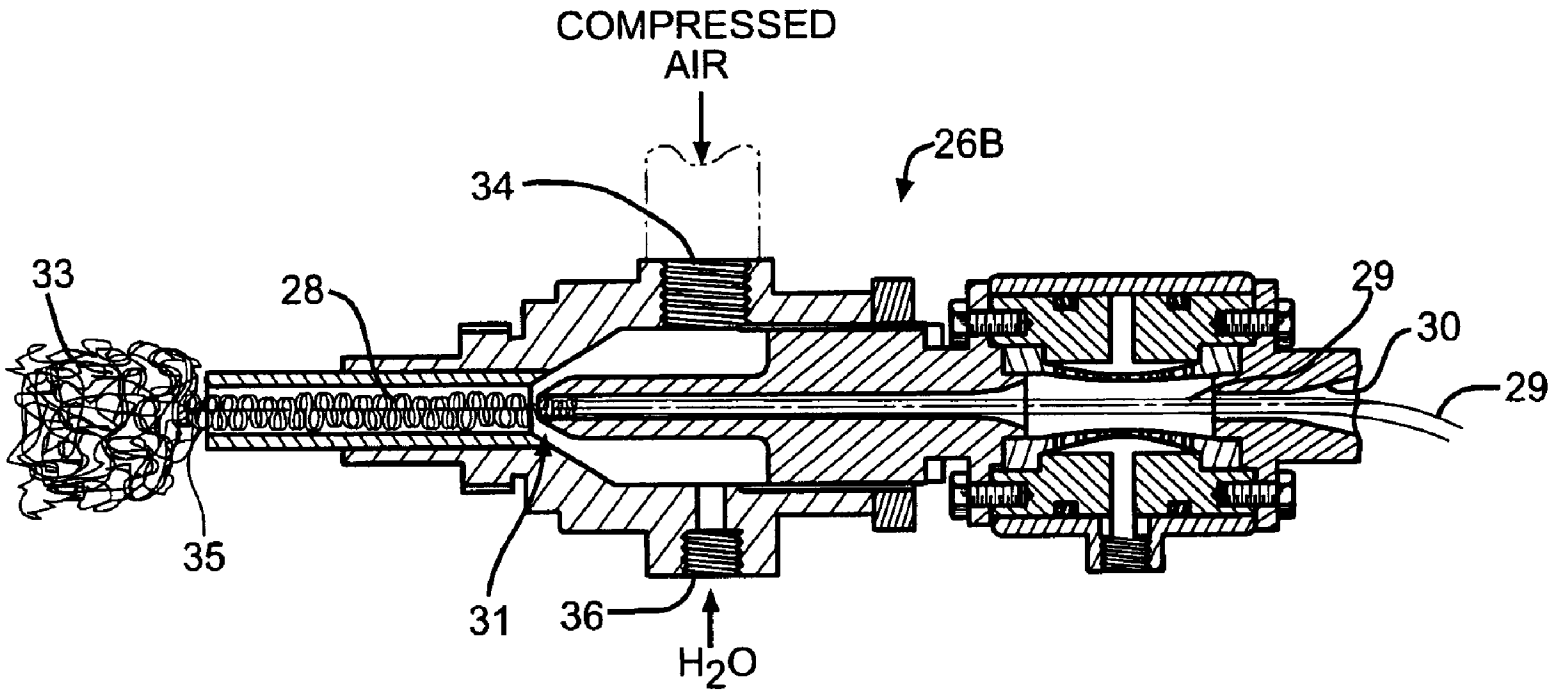
FIG. 9 is a cross-sectional view in elevation of a second embodiment of the filling apparatus that texturizes and then wets the fibrous material using moisturized compressed air to insert the fibrous material into the enclosed muffler chamber.
Figure 10:
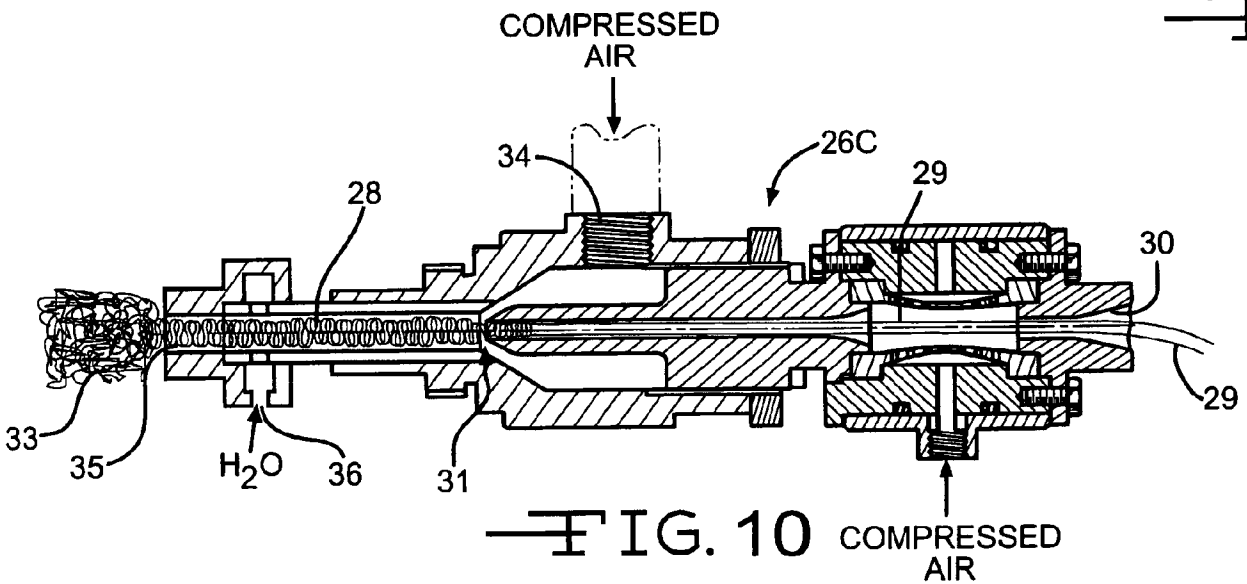
FIG. 10 is a cross sectional view in elevation of the filling apparatus used to first texturize and then wet the fibrous material prior to inserting the fibrous material into the enclosed muffler chamber.

FIGS. 8–10 illustrate various embodiments of the filling apparatus 26 used to fill the muffler chamber 14 with fibrous material in accordance to the method of the present invention. The filling apparatus 26 is comprised of a fibrous material inlet 30, at least one compressed air inlet 34, a fluid inlet 36, a texturizing chamber 31, and a filling nozzle 28. In a first embodiment, shown in FIG. 8, the fluid inlet 36 may be connected to the compressed air inlet 34. In a second embodiment, shown in FIG. 9, the fluid inlet 36 is independent of the compressed air inlet 34. In a third embodiment, shown in FIG. 10, the fluid inlet 36 is attached to the filling nozzle 28.

FIG. 8 illustrates the filling apparatus 26 having a fluid inlet 36 connected to the compressed air inlet 34. To fill the muffler chamber 14, a rope 29 of fibrous material is inserted into the fibrous material inlet 30. The rope 29 of fibrous material is preferably a multi-stranded rope of straight glass fibers, although it will be appreciated that any suitable fibrous material may be used. As the rope 29 is fed through the filling apparatus 26, the rope 29 enters a texturizing chamber 31. The compressed air inlet 34 provides compressed air to the texturizing chamber 31. The fluid inlet 36, which is connected to the compressed air inlet 34, provides a metered flow of fluid into the compressed air prior to the compressed air's entering the texturizing chamber 31. The addition of the fluid moisturizes the compressed air.

Preferably, the fluid used to moisturize the compressed air is water, although it will be appreciated many suitable wetting fluid may be used to moisturize the compressed air. When the rope 29 enters the texturing chamber 31, the moisturized compressed air within the texturizing chamber 31 separates and tumbles the individual glass fibers 33 of the rope 29. The moisture in the compressed air also wets the individual glass fibers 33 during this texturizing process. After the fibers 33 have been texturized and wetted, the fibers 33 are advanced into the filling nozzle 28. The fibers 33 are propelled by the compressed air in the texturing chamber 31 through the filling nozzle 28 and out an open end 35 in the filling nozzle 28. The open end 35 of the filling nozzle 28 is inserted into the fill opening 18 of the temporary form 12.

The texturizing of the individual glass fibers 33 fluffs the individual glass fibers 33 by bending and twisting the fibers 33, which allows the fibers 33 to fill the muffler chamber 14 when the fibers 33 are inserted. The wetting of the fibers 33 supplies a cohesive force that keeps the texturized fibers 33 from expanding beyond the bounds of the shape set by the temporary form 12 when the temporary form 12 is removed. Where a single outer shell 50 configuration is used, the cohesive force of the wetted fibers prevents the texturized fibers 33 from expanding beyond the bounds of the outer shell 50. The holding together of the wetted fibers provide provides a particular advantage over unwetted fibers because the wetted fibers will subsequently not expand or spring out of the temporary form 12 when the temporary form 12 is removed from the lower outer shell 10. Where a single outer shell construction is used, the wetted fibers will not expand or spring out of the muffler chamber 14 defined by the outer shell 50. Thus, the cohesive force supplied by the wetting process prevents substantially any of the fibers from straying onto the joining surface for either the lower outer shell 10 and the upper outer shell 40 or the outer shell 50 and the end caps 53.

FIG. 9 shows a second embodiment of the filling apparatus 26B, which contains a fluid inlet 36 that is independent of the compressed air inlet 34. The fluid inlet 36 provides a fluid source directly into the texturizing chamber 31, as opposed to connecting the fluid inlet 36 to the compressed air inlet 34 to moisturize the compressed air, as in the previous embodiment. The compressed air inlet 34 supplies compressed air, which is not moisturized, into the texturizing chamber 31. When the rope 29 enters the texturizing chamber 31, the compressed air within the texturizing chamber 31 separates and tumbles the individual glass fibers 33 of the rope 29. At the same time that texturization of the fibers 33 occurs, a metered flow of fluid is dispensed into the texturizing chamber 31. The fluid provided directly into the texturizing chamber 31 wets the fibers 33 during the texturization process before they are moved by the compressed air into the filling nozzle 28. Preferably, the fluid used to wet the fibers 33 is water, although it will be appreciated that any suitable wetting fluid may be used to wet the fibers 33. After the fibers 33 have been texturized and wetted, the fibers 33 are advanced into the filling nozzle 28. The fibers 33 are propelled by the compressed air in the texturing chamber 31 through the filling nozzle 28 and out an open end 35 in the filling nozzle 28. The open end 35 of the filling nozzle 28 is inserted into the fill opening 18 of the temporary form 12.

FIG. 10 shows a third embodiment of the filling apparatus 26C, which also contains a fluid inlet 36 that is independent of the compressed air inlet 34. However, in this embodiment, the fluid inlet 36 provides fluid into the filling nozzle 28 instead of into the texturizing chamber 31. As with the second embodiment, the compressed air inlet 34 supplies compressed air, which is not moisturized, into the texturizing chamber 31. When the rope 29 enters the texturizing chamber 31, the compressed air within the texturizing chamber 31 separates and tumbles the individual glass fibers 33 of the rope 29. After the fibers 33 have been texturized, the fibers 33 are advanced into the filling nozzle 28. A fluid inlet 36 positioned on the filling nozzle 28 supplies a metered fluid flow into the filling nozzle 28. Preferably, the fluid used to wet the fibers 33 is water, although it will be appreciated that any suitable wetting fluid may be used to wet the fibers 33. As the fibers 33 enter the filling nozzle 28 they are wetted by the fluid provided in the filling nozzle 28. The texturized and wetted fibers 33 are then expelled out the open end 35 in the filling nozzle 28. The open end 35 of the filling nozzle 28 is inserted into the fill opening 18 of the temporary form 12.

Regardless of which filling apparatus configuration is used, the fibers 33 entering the muffler chamber 14 from the filling nozzle 28 are always wetted. To achieve an adequate cohesive force to hold the wetted fibers 33 together, it is preferable to either have sufficient moisture content in the compressed air where moisturized air is used for wetting, or to have sufficient fluid flow over the fibers 33 where a separate wetting process is used. In a preferred embodiment, the amount of moisture content provided to the fibers 33 is within the range of from about five to about fifty percent of the weight of the combined fibers 33 and moisture. It will be appreciated, however, that any suitable amount of moisture content sufficient to hold the fibers 33 together may also be used.

Figure 7:
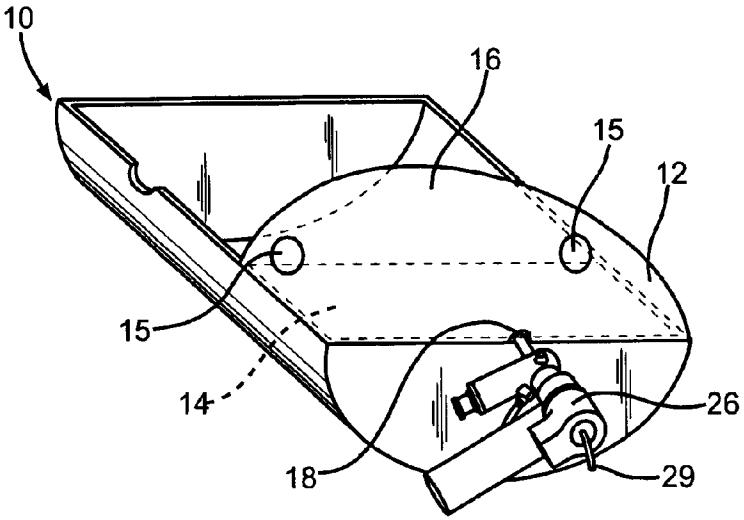
FIG. 7 is a schematic view in perspective of the enclosed muffler chamber being filled with fibrous material according to the method of the invention.
Figure 11:
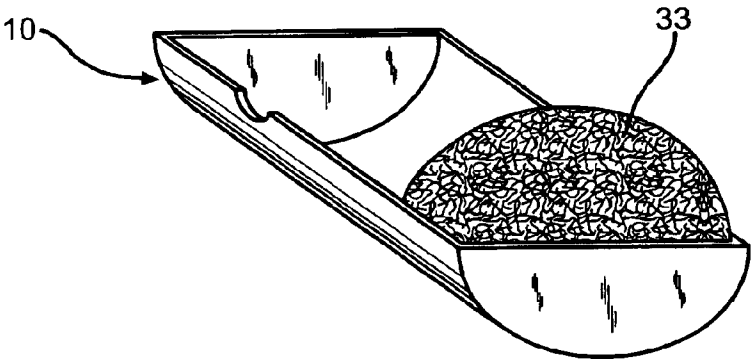
FIG. 11 is a schematic view in perspective of the fibrous material inserted into the lower outer shell.
Figure 12:
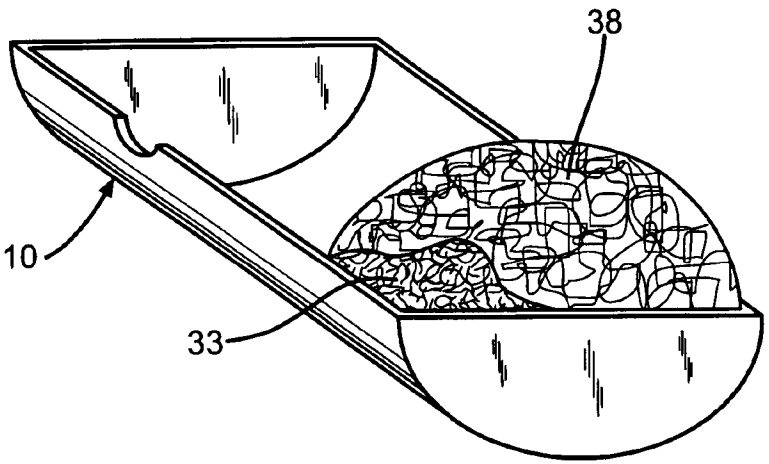
FIG. 12 is a schematic view in perspective of the fibrous material encased in a protective material after the fibrous material has been inserted into the lower outer shell.

Returning to FIG. 7, after the filling nozzle 28 has been inserted into the fill opening 18 of the temporary form 12, the wetted fibers 33 are inserted into the muffler chamber 14. As previously discussed, a partial vacuum may be drawn within the muffler chamber by attaching vacuum hoses to the sealable outlets 15 on the temporary form 12 to draw the wetted fibers 33 into the muffler chamber 14, although drawing of the partial vacuum is not required. The muffler chamber 14 is filled with any suitable amount of wetted fibers 33 to obtain any desired amount of sound muffling capability. After the muffler chamber 14 is filled with the desired amount of wetted fibers 33, the filling apparatus 26 is removed from the fill opening 18 and the temporary form 12 is removed from the lower outer shell 10. FIG. 11 illustrates the wetted fibers 33 in the lower outer shell 10 following the removal of the temporary form 12. The wetted fibers 33 maintain the shape of the temporary form 12 due to the moisture on the wetted fibers 33 that serves to hold the fibers 33 together and substantially prevents the wetted fibers 33 from expanding beyond the shape of the temporary form 12 once the temporary form 12 is removed. As shown in FIG. 12, a layer of protective material 38 may also be used to encase the wetted fibers 33 to further insure that the shape of the wetted fibers 33 is maintained as the fluid applied to the wetted fibers 33 evaporates. It will be appreciated, however, that the protective material 38 is not required to maintain the shape of the fibers 33, as the moisture applied to the fibers 33 has sufficient cohesive force to maintain the fibers 33 in the shape set by the temporary form 12. The layer of protective material 38 may be any suitable material for use in exhaust mufflers. Examples of such suitable protective materials include a protective sheet 38 made from paper or a protective sheet 38 made from glass fibers.

Following the removal of the temporary form 12 and the optional application of a protective material 38 over the wetted fibers 33, the lower outer shell 10 filled with the wetted fibers 33 is ready to be combined with its companion upper shell 40. As shown in FIG. 12, the upper shell 40 is placed over the wetted fibers 33 and fitted onto the lower outer shell 10. Because the wetted fibers 33 are held together by the moisture applied during the filling process, the joint between the upper outer shell 40 and the lower outer shell 10 remains substantially free from any stray fibers 33 that would otherwise have interfered with the joining process. The upper outer shell 40 and the lower outer shell 10 are joined together using any suitable mechanical fastening means to create a finished muffler assembly. In a preferred embodiment, a weld joint 44 joins the upper outer shell 40 and lower outer shell 10.

The principle and mode of operation of this invention have been described in its preferred embodiments. However, it should be noted that this invention can be practiced otherwise than as specifically illustrated and described without departing from its scope.

What is claimed is:

1. A method for filling a muffler shell with a fibrous material comprising the steps of:

(a) providing an outer muffler shell;

(b) applying a temporary form to the outer shell to define a muffler chamber within the outer muffler shell;

(c) wetting the fibrous material by forcing moisturized compressed air into contact with the fibrous material;

(d) inserting the wetted fibrous material into the muffler chamber; and (e) removing the temporary form from the outer muffler shell.

2. The method of claim 1 wherein the outer muffler shell of step (a) is comprised on an upper outer shell and a lower outer shell, and wherein the temporary form of step (b) is applied to the lower outer shell.

3. The method of claim 1 wherein the fibrous material in step (c) is simultaneously textured and wetted by forcing moisturized compressed air into contact with the fibrous material.

4. The method of claim 1 wherein the inserting step (d) is accomplished by drawing a partial vacuum in the enclosed muffler chamber while inserting the fibrous material to draw the fibrous material into the enclosed muffler chamber.

5. The method of claim 1 wherein the compressed air is moisturized by using water.

6. The method of claim 1 wherein the compressed air has sufficient moisture to wet the fibrous material to a moisture content that is within the range of from about five to about fifty percent of the weight of the combined fibrous material and moisture.

7. The method of claim 1 wherein the fibrous material inserted into the outer shell is covered with a layer of protective material following step (e) such that the material encases the fibrous material extending over the outer shell.

8. The method of claim 7 wherein the protective material used to cover the fibrous material is a fibrous glass material.

9. The method of claim 7 wherein the protective material used to cover the fibrous material is paper.

10. A method for filling a muffler shell with a fibrous material comprising the steps of:

(a) providing an outer muffler shell having at least one muffler chamber defined within the outer muffler shell;

(b) wetting the fibrous material by forcing moisturized compressed air into contact with the fibrous material; and (c) inserting the wetted fibrous material into the muffler chamber.

11. The method of claim 10 wherein the fibrous material in step (b) is simultaneously texturized and wetted by forcing moisturized compressed air into contact with the fibrous material.

12. The method of claim 10 wherein the compressed air is moisturized by using water.

13. The method of claim 10 wherein the compressed air has sufficient moisture to wet the fibrous material to a moisture content that is within the range of from about five to about fifty percent of the weight of the combined fibrous material and moisture.

14. The method of claim 10 wherein the fibrous material inserted into the outer muffler shell is covered with a layer of protective material following step (c) such that the material encases the fibrous material extending over the outer muffler shell.

15. The method of claim 14 wherein the protective material used to cover the fibrous material is a fibrous glass material.

16. The method of claim 14 wherein the protective material used to cover the fibrous material is paper.

17. A method for filling a muffler shell with a fibrous material comprising the steps of:

(a) providing a muffler shell having a lower outer shell;

(b) applying a temporary form to the lower outer shell to define a muffler chamber within the lower outer shell;

(c) texturizing the fibrous material by forcing compressed air through the fibrous material;

(d) wetting the texturized fibrous material by applying water to the texturized fibrous material;

(e) inserting the texturized and wetted fibrous material into the enclosed muffler chamber; and (f) removing the temporary form from the lower outer shell.

18. The method of claim 17 wherein the inserting step (e) is accomplished by drawing a partial vacuum in the enclosed muffler chamber while inserting the fibrous material to draw the fibrous material into the enclosed muffler chamber.

19. The method of claim 17 wherein the fluid is applied to the texturized material such that the fibrous material is wetted to a moisture content that is within the range of from about five to about fifty percent of the weight of the combined fibrous material and fluid.

20. The method of claim 17 wherein the fibrous material inserted into the lower outer shell is covered with a layer of protective material following step (f) such that the material encases the fibrous material extending over the lower outer shell.

21. The method of claim 20 wherein the protective material used to cover the fibrous material is a fibrous glass material.

22. The method of claim 20 wherein the protective material used to cover the fibrous material is paper.

23. A method for filling a muffler shell with a fibrous material comprising the steps of:

(a) providing a muffler shell having a lower outer shell;

(b) applying a temporary form to the lower outer shell to define a muffler chamber within the lower outer shell;

(c) simultaneously texturizing and wetting the fibrous material by forcing moisturized compressed air into contact with the fibrous material;

(d) inserting the wetted fibrous material into the muffler chamber; and (e) removing the temporary form from the lower outer shell.

24. The method of claim 23 wherein the inserting step (d) is accomplished by drawing a partial vacuum in the enclosed muffler chamber while inserting the fibrous material to draw the fibrous material into the enclosed muffler chamber.

25. The method of claim 23 wherein the compressed air is moisturized by using water.

26. The method of claim 23 wherein the compressed air has sufficient moisture to wet the fibrous material to a moisture content that is within the range of from about five to about fifty percent of the weight of the combined fibrous material and moisture.

27. The method of claim 23 wherein the fibrous material inserted into the lower outer shell is covered with a layer of protective material following step (e) such that the fibrous material extending over the lower outer shell is encased by the material.

28. The method of claim 27 wherein the protective material used to cover the fibrous material is a fibrous glass material.

29. The method of claim 27 wherein the protective material used to cover the fibrous material is paper.

* * * * *